US005749113A

United States Patent [19]

Witter

[11] Patent Number: 5,749,113

[45] Date of Patent: May 12, 1998

[54] DRYWALL TOOL

[76] Inventor: Lowell F. Witter, 450 S. Belmont, Elgin, Ill. 60123

[21] Appl. No.: 603,402

[22] Filed: Feb. 20, 1996

[51] Int. Cl.[6] ..... B66F 15/00

[52] U.S. Cl. ..... 7/166; 254/131; 254/25

[58] Field of Search ..... 7/166; 81/45; 254/18, 254/21, 25, 28, 113, 120–122, 131, 131.5

[56] References Cited

U.S. PATENT DOCUMENTS

| | | | |
|---|---|---|---|
| 347,019 | 8/1886 | Whytal | 254/25 |
| 394,547 | 12/1888 | Thacker | 7/166 |
| 941,476 | 11/1909 | Wakeley | 254/25 |
| 988,208 | 3/1911 | Porter | 254/25 |
| 1,270,970 | 7/1918 | Rich | 254/131 |
| 1,494,559 | 5/1924 | Lumry et al. | 254/131.5 X |
| 2,503,683 | 4/1950 | Perkins | 254/131 X |
| 3,813,081 | 5/1974 | Alger | 254/131 |
| 4,183,503 | 1/1980 | Ward | 254/131 |
| 4,203,210 | 5/1980 | Hadlick, Jr. | 254/131.5 X |
| 4,708,320 | 11/1987 | Hodges | 254/131 X |

*Primary Examiner*—D. S. Meislin

*Attorney, Agent, or Firm*—Brinks Hofer Gilson & Lione; Craig A. Summerfield

[57] ABSTRACT

An apparatus for cleanly and easily removing nails from drywall has a shaft portion with a narrowing portion having a first end attached to the shaft portion and a second end having a width narrower than the width of the narrowing portion first end. The narrowing portion and the shaft portion, in combination, are substantially flat. A prong is placed at an angle to the narrowing portion on the narrowing portion second end, and the prong has a width similar to the narrowing portion second end. Further, a radius portion near the shaft portion first end extends from the shaft portion or narrowing portion. The radius portion has a width similar to the narrowing portion first end and is rounded. The radius portion and the shaft portion form a gap area between the prong and the radius portion. A drywall installation and nail remover has a shaft portion and a prong placed on the shaft portion at an angle to the shaft first end. A slide is movably attached to the shaft portion so that the slide is moveable to partially cover the prong.

21 Claims, 2 Drawing Sheets

DRYWALL TOOL

BACKGROUND OF THE INVENTION

The present invention relates generally to tools. More particularly, the invention relates to a tool for removing nails from drywall, aiding in drywall and paneling installation, and also removing window, door and base trim.

Generally, nails in drywall or other materials are removed by using a claw or prong device. Claws are found on hammers and on crowbars. The claw is slid under the nail. However, many times the nail is flush with the drywall and the claw must be forced under the nail. Forcing the claw often results in ripping up the drywall or destroying a painted surface. Many times, a nail in drywall may be embedded below the surface of the drywall. Forcing the claw under these nails results in even more damage to the drywall.

Further, once forced under a nail, the hammer or crowbar must have force applied to remove the nail. Movement of the hammer or crowbar acts to pull the nail from the drywall. Usually, a portion of the hammer or crowbar presses against the drywall as the tool is moved. As pressure is applied to remove the nail, often an indention or even a hole is created in the drywall by the hammer or crowbar.

The distance between the point of contact with the nail and the place a hammer or crowbar rests on the drywall often does not vary sufficiently as the nail is removed. The lack of variance results in bending the nail as it is removed. Removing a bent nail often requires more force, resulting in a greater likelihood of creating a hole or other mark on the drywall.

Crowbars with claws were developed that have curved portions to allow for proper variance in distance as a nail or other object is removed. See U.S. Pat. No. 3,134,574. However, these crowbars do not protect the drywall sufficiently and the curved portion makes the crowbar difficult to manufacture. The crowbar in U.S. Pat. No. 3,134,574 is rounded across its width, which results in a small contact point with the drywall. A small contact point is more likely to cause damage to the drywall. Further, the nail prong is wide and long, so placing the prong under a flush nail damages a large swath of the drywall.

Drywall work often involves more than removing nails. As a sheet of drywall is installed, the drywall must be held off of the floor. A crowbar may be used for this purpose. However, thin crowbars make balancing the drywall more difficult and wide crowbars result in prongs which cause large damage marks when a nail is removed.

Therefore, there is a need for an apparatus that cleanly and easily removes nails from drywall and still provide proper support for holding drywall away from the floor.

SUMMARY OF THE INVENTION

The present invention provides an apparatus for cleanly and easily removing nails from drywall. The drywall nail remover comprises a shaft portion with a narrowing portion having a first end attached to the shaft portion and a second end having a width narrower than the width of the narrowing portion first end. The narrowing portion and the shaft portion, in combination, are substantially flat. A prong is placed at an angle to the narrowing portion on the narrowing portion second end. Further, a cylindrical radius portion near the shaft portion first end extends from the shaft portion or narrowing portion. The radius portion has a width greater than the narrowing portion second end and the prong. The radius portion is rounded. The radius portion and the shaft portion form a gap area between the prong and the radius portion.

In another aspect of the invention, a drywall installation, nail and trim remover is provided. The remover comprises a shaft portion and a prong placed on the shaft portion at an angle to the shaft first end. A slide is movably attached to the shaft portion so that the slide is moveable to partially cover the prong.

It is to be understood that both the foregoing general description and the following detailed description are exemplary and are intended to provide further explanation of the invention as claimed. The invention, together with further objects and attendant advantages, are best understood by reference to the following detailed description in conjunction with the attached drawings.

DETAILED DESCRIPTION OF THE PRESENTLY PREFERRED EMBODIMENTS

Figure 1:
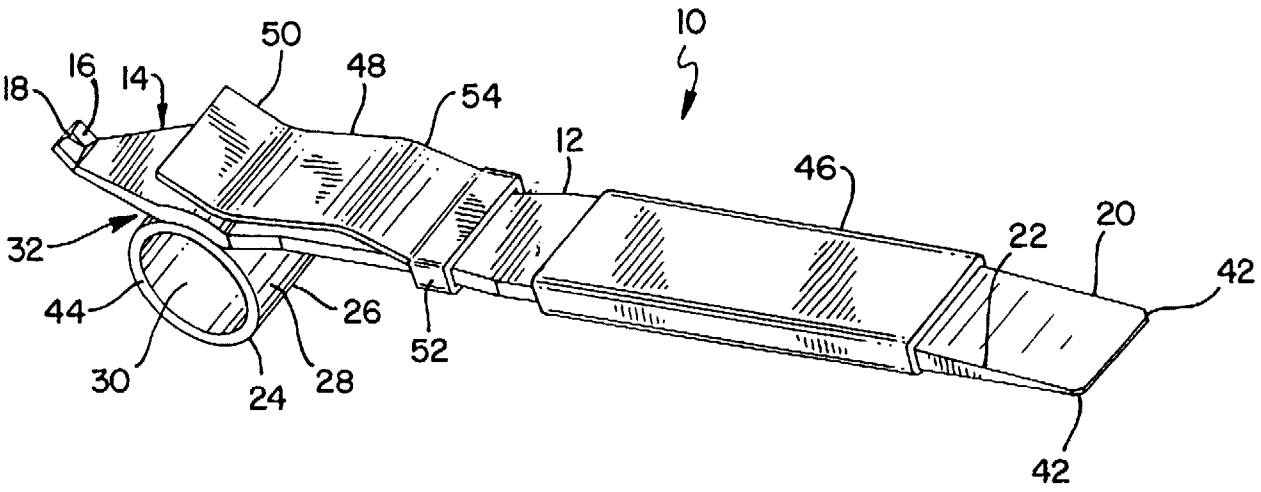
FIG. 1 is a perspective view of a drywall paneling installation, nail and trim removal tool.

Referring now to the drawings and more particularly to FIG. 1, the drywall nail and trim removal and installation tool is generally shown at 10. The tool 10 includes a shaft 12, a narrowing portion 14, and a prong 16. The narrowing portion 14 is connected to one end of the shaft 12. Preferably, the shaft 12, prong 16, and narrowing portion 14 are of a uniform singular construction of hardened and tempered steel or stainless steel. The shaft 12 and narrowing portion 14 are substantially flat as can best be seen in FIG. 2. Slight bend 34 is preferably the only non-flat portion of shaft 12 and narrowing portion 14. Slight bend 34 exists for reasons to be discussed below. Shaft 12, as shown, has a rectangular cross-section, but may have a cross-section of any shape.

Figure 3:
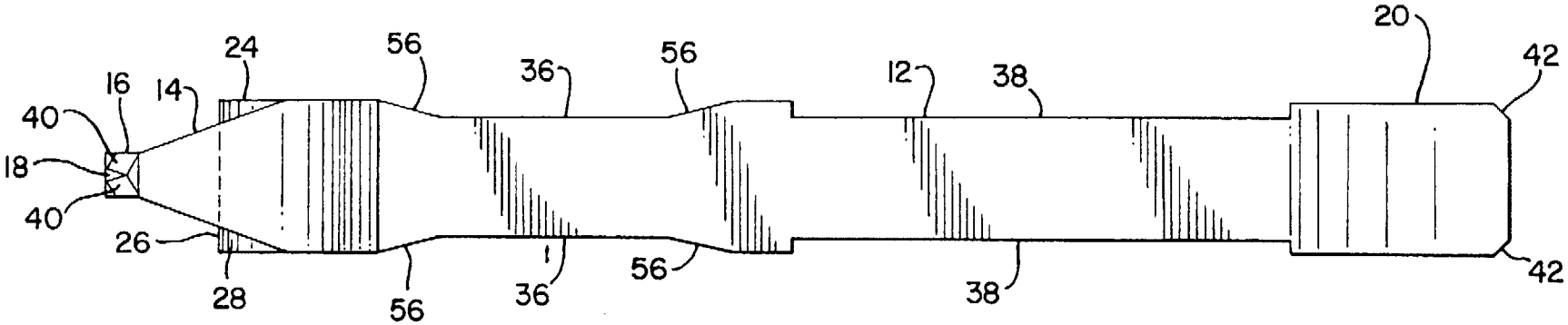
FIG. 3 is a top view of the tool of FIG. 2.

As can best be seen in FIG. 3, shaft 12 has a substantially uniform width. Slide indentions 36 and handle indentions 38 make the width of shaft 12 not exactly uniform. Slide indentions 36 and handle indentions 38 are discussed below. The end of narrowing portion 14 that connects to shaft 12 is preferably of the same width as shaft 12. The other end of narrowing portion 14 has a width that is smaller than the width of shaft 12. However, the shaft 12 and narrowing portion 14 may have uniform width across their entirety that is as narrow as the narrowest end of narrowing portion 14. The narrowest end of narrowing portion 14 must only be more narrow than the footprint of radius portion 24, as is discussed in more detail below. Preferably, the narrowest end of narrowing portion 14 is only slightly wider than a typical drywall nail.

Figure 2:
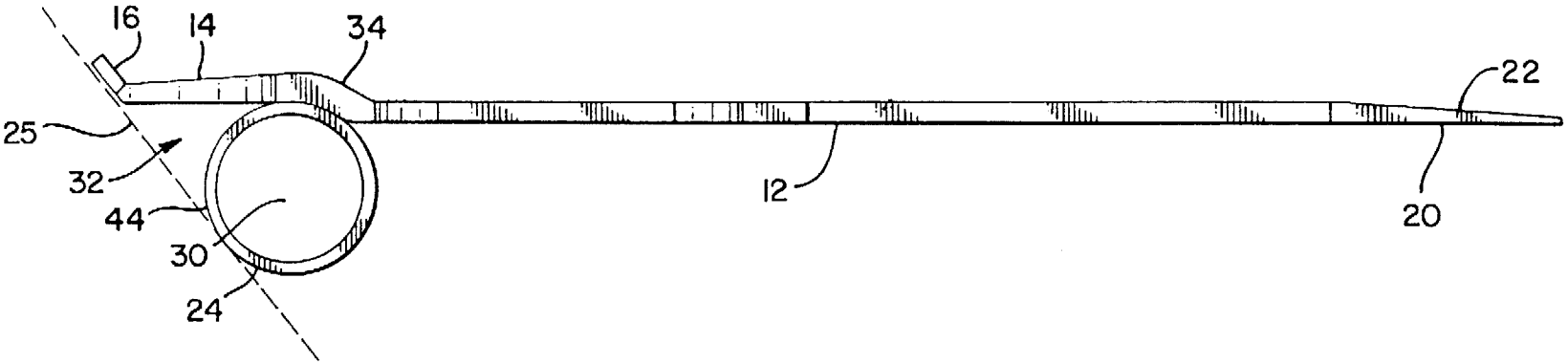
FIG. 2 is a left side view of a nail and trim removal tool without a grip.

Prong 16 attaches to the narrowest end of narrowing portion 14. Preferably, prong 16 has the same width as the narrowest portion of narrowing portion 14. Prong 16 is also preferably made of hardened and tempered steel and heat treated. Prong 16 has an angular cutout 18 that is preferably V-shaped. The angular cutout 18 has tapered edges 40. Both edges 40 are tapered so that the prong 16 may be slid underneath the head of various sized nails with varying head designs. As can be seen in FIG. 2, the prong 16 is placed at an obtuse angle to narrowing portion 14 and, thus, to shaft 12. The angle may vary but is preferably approximately 125°, so that as the tool 10 is used, the shaft 12 is not against a wall or ceiling when the prong 16 is slid underneath the head of a nail at a corner formed by the ceiling and wall. This allows a space from the wall and shaft 12 for a person's hand to hold the tool 10 when prong 16 slides under the head of the nail. Preferably, prong 16 extends from the narrowing portion 14 only a distance sufficient to allow prong 16 to slide under the head of a nail and give sufficient support to remove the nail. Thus, prong 16 generally surrounds the nail for adequate support to remove the nail even if the nail has been driven into the drywall on a wall stud. Prong 16 needs clearance between any wall stud and the head of the nail for insertion of prong 16 under the head of the nail.

The shaft 12 also has a tapered end 20, as can best be seen in FIG. 2. The taper 22 on tapered end 20 is preferably only on the top side of shaft 12. Preferably, the taper 22 is gradual so that the tapered end 20 may act as a cutter on drywall paper or may be slid under trim to remove the trim. The tapered end 20 is preferably heat treated. Referring now to FIG. 3, the tapered end 20 has angled edges 42. Preferably, these angled edges 42 are the corners of the tapered end 20. The angled-edges are preferably slightly rounded. The angled edges 42 remove the paint or drywall off the head of the nail. Preferably, the tapered end 20 is not sharp, but may be used to cut or shave off the high areas of the wall or ceiling after the nail is removed from a nail pop.

Referring now to FIGS. 2 and 3, extending from the shaft 12 is a radius portion 24. Radius portion 24 is placed near the narrowing portion 14. Preferably, the radius portion 24 is made from hardened and tempered steel or stainless steel. Radius portion 24 could be connected to narrowing portion 14 instead of shaft 12. The radius portion 24 is preferably a cylinder with an aperture 30 passing through the cylinder's center axis. However, the radius portion 24 could be any geometrical shape. Cylinder is used to denote a substantially flat height and a diameter. The diameter of the cylinder of radius portion 24 is great enough to allow the narrowing portion 14 to act as a moment arm and pull the nail generally straight out of the drywall. The radius portion 24 has a circular circumference 44. The circular circumference 44 provides a rounded surface 28. The rounded surface 28 allows for an even contact or footprint with drywall and paneling as tool 10 is rotated. As tool 10 is rotated, the area of contact 26 with the drywall of rounded surface 28 moves along a portion of the circular circumference 44. Preferably, rounded surface 28 is smooth so that if needed, the surface 28 slides on drywall and paneling. The height of the cylinder, and thus the width of radius portion 24 as can be seen in FIG. 3, is preferably approximately the same as the width of the shaft 12. The contact surface 26 should be flat across the width of radius portion 24. The width of radius portion 24 along the contact surface 26 at any given point during removal of a nail is preferably approximately 2", corresponding to a dimension of a standard 2×4 wall stud. This width allows an even disbursement across a greater area of the normal force to the drywall. The width of the contacting surface 26 must be sufficient to generally avoid putting holes in drywall while resting over a wall stud. Any portion of radius portion 24 that does not contact the drywall for support as the tool 10 is rotated may be of any width. In comparison, prong 16 must be small enough, including a small width, to allow minimal destruction of drywall when placing prong 16 underneath a nail head located at the drywall surface or driven deep into the drywall. The width of shaft 12 is preferably convenient for gripping and thus about 1½". Thus, prong 16 is preferably less than twice the width of shaft 12.

The placement of the radius portion 24 relative to the length of shaft 12 determines the angle at which prong 16 is attached to narrowing portion 14. Prong 16 is placed at an angle along the conceptual line 25 that passes through prong 16 and tangential to the radius portion 24. However, the angle may vary slightly to allow for the insertion of the prong 16 and the lower portion of the narrowing portion 14 into a hole in the drywall. The narrowing portion 14 and radius portion 24 act to form a gap area 32. Gap area 32 allows prong 16 and the lower part of narrowing portion 14 to be inserted into a hole in the drywall to reach and extract nails driven into the drywall without obstruction.

Shaft 12 has handle indentions 38 as shown in FIG. 3. Referring now to FIG. 1, a grip 46 is placed around shaft 12. Handle indentions 38 act to keep the grip 46 in place. Preferably, the grip 46 is made of plastic or other suitable polymer made from petroleum types of materials. The handle indentions 38 may be gradual curves instead of the rectangular indentions shown and act to hold grip 46 in place.

Figure 5:
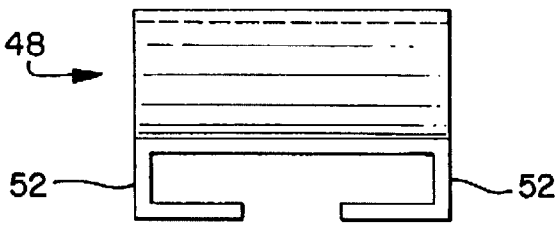
FIG. 5 is a front side view of the slide of FIG. 4.
Figure 4:
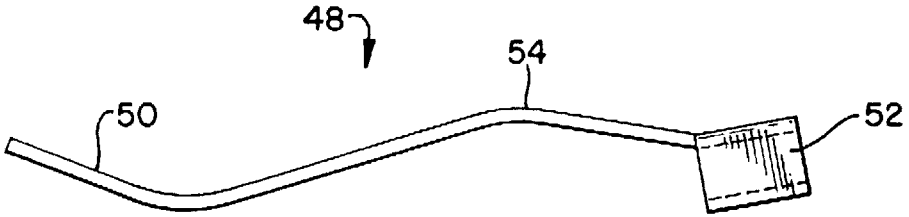
FIG. 4 is a left side view of a slide for use on the drywall paneling installation, nail and trim removal tool of FIG. 1.

A slide 48, as shown in FIGS. 1, 4, and 5, is mounted on shaft 12. The slide 48 may be moved forward on shaft 12 so that a portion of slide 48 covers prong 16. An indention in slide 48 may be provided for mating with the prong 16. Slide 48 may then be moved away so that prong 16 is exposed. The slide 48 preferably has an angled portion 50 that is at an angle to shaft 12, but is similar to the angle of prong 16 to narrowing portion 14. As shown in FIGS. 1 and 5, the slide 48 also has extensions 52. These extensions 52 wrap around shaft 12 and allow slide 48 to move along shaft 12. Preferably, the extensions 52 wrap around the sides and part of the underside or bottom of shaft 12. The angled portion 50 of slide 48 is on the slide side or top of shaft 12. As shown in FIG. 3, slide indentions 36 are provided on shaft 12. As extensions 52 reach either end of slide indentions 36, the shaft 12 prevents any further movement of slide 48. The slide indentions 36 have slanted ends 56 that works as a wedge to hold extensions 52 in place. Further, when slide 48 is not covering prong 16, the curve portion 54, at the intersection with angled portion 50, in conjunction with bend 34 acts to keep the slide 48 from moving forward to cover prong 16. Preferably, the slide 48 is made from hardened steel. The slide 48 has a curved portion 54 that is shaped so that it mates with the bend 34 of shaft 12 as shown in FIG. 2. This mating acts to hold the slide 48 in place on shaft 12 so that the angled portion 50 of slide 48 is covering prong 16. The width of slide 48 and in particular the angled portion 50 of slide 48 is preferably approximately as wide as the contact area 26 of radius portion 24.

To remove a nail from drywall, the drywall nail removal tool 10 is used. First, the angled edge 42 is used to locate the head of the nail by removing paint and drywall off the head of the nail. If the nail is driven into the drywall, the angled edge 42 is used to dig a small hole to locate the nail. Only a small hole is necessary in the drywall since prong 16 and the narrow part of the narrowing portion 14 are the only part of the tool 10 which must be inserted into the hole. Gap 32 allows insertion of the prong 16 and narrowing portion 14 into the hole. No hole in the drywall is needed if the nail is at or above the drywall surface. Then, prong 16 is pushed underneath the nail head with the shank of the nail being placed within angled cutout 18. Preferably, the nail shank is placed in the narrowest portion of angled cut out 18 as is possible. Thus, tapered edges 40 contact the bottom of the nail head as the nail is removed. The contact surface 26 of radius portion 24 is then placed on the drywall, preferably over a stud. The nail is then removed from the drywall by applying a torque force to shaft 12. As the nail is removed, prong 16 moves away from the drywall surface and the contact surface 26 of radius portion 24 continually changes around rounded surface 28. Radius portion 24 may slide forward for better support as the nail is removed. This allows the nail to be lifted generally straight out of the drywall and avoids bending the nail and causing damage to the drywall. Once the nail is removed, the angled edge 42 is once again used to cut away any torn and broken drywall paper or chunks of drywall that have come loose. Finally, the tapered end 20 is used to shave off any material that extends above the surface of the drywall and a layer of paint around the hole on the drywall. Since the shaft 12 and thus tapered end 20 are preferably a uniform width that is greater than the width of prong 16, the tapered end 20 should slide over the entire hole in the drywall. Tapered end 20 shaves the high area from the wall in either a clock-wise or counter clock-wise movement, shaving one side of the hole at a time.

Tool 10 can also be used to remove nails and screws from tires. Furthermore, the intersection of radius portion 24 with shaft 12 at bend 34 opposite gap 32 can be used to hang tool 10 on a tool belt. Preferably, slide 48 covers prong 16 when tool 10 is secured to a tool belt.

To install a piece of drywall or paneling, the drywall or paneling is preferably held above the floor. The tool 10 provides a simple yet efficient way to do so. Slide 48 is moved forward so that the curve portion 54 mates with the bend 34. The angled portion 50 is then covering prong 16. Angle portion 50 is longer than prong 16 so that prong 16 does not touch the floor when angled portion 50 and radius portion 24 rest on the floor. Angle portion 50 is placed under the drywall or paneling. Radius portion 24 is placed against the floor. Torque can then be applied to shaft 12, which results in raising the drywall or paneling off the floor. The width and length of the angle portion 50 of slide 48 is such that better balancing and support is provided compared to using prong 16. Once the drywall is nailed or screwed in place, the tool 10 may be removed. If a nail must be removed, then the slide 48 is moved away from prong 16. The tool 10 also can be used while installing doors or other items that need to be elevated slightly off the floor, as described above.

Of course, it should be understood that a wide range of changes and modifications can be made to the preferred embodiment described above. For example, various widths may be used as long as the prong 16 is narrower than the contact surface 26. Thus, it is intended that the foregoing detailed description be regarded as illustrative rather than limiting.

It is the following claims, including all equivalents, which are intended to define the scope of this invention.

I claim:

1. A drywall nail removal apparatus, said apparatus comprising:

a) a shaft portion having a first end and a second end;

b) a radius portion extending from said shaft portion, wherein:

i) the radius portion has a contact surface that is rounded, the contact surface having a first width;

ii) the radius portion comprises a cylinder having at least one height and a diameter; and iii) the one height of the cylinder comprises the first width, and the diameter comprises a distance the radius portion extends from said shaft portion;

c) a narrowing portion having a narrowing portion first end attached to the shaft portion first end and a second end having a second width narrower than the first width, the narrowing portion and the shaft portion, in combination, being substantially flat;

d) a prong placed at an obtuse angle to the narrowing portion on the narrowing portion second end, the prong having a third width narrower than the first width; and e) the radius portion and the narrowing portion forming a gap area between the prong and the radius portion.

wherein said prong lies in a plane, said plane extending substantially tangential to the radius portion.

2. The apparatus of claim 1 wherein the shaft portion has a substantially uniform width.

3. The apparatus of claim 2 wherein the shaft portion width is the same as the first width.

4. The apparatus of claim 1 wherein the cylinder has an aperture passing through the cylinder's center axis.

5. The apparatus of claim 4 wherein the shaft portion has a bend conforming to a shape of said cylinder in engagement with the radius portion.

6. The apparatus of claim 4 wherein the shaft portion second end comprises a tapered end.

7. The apparatus of claim 6 wherein the shaft portion second end has an angled edge.

8. The apparatus of claim 7 wherein the angled edge is a corner of the shaft portion second end.

9. The apparatus of claim 8 wherein a grip covers at least a portion of the shaft portion.

10. The apparatus of claim 1 wherein the second width is less than half the first width.

11. The apparatus of claim 1 wherein the contact surface is smooth.

12. The apparatus of claim 1 wherein:

a) the prong has an angular cut-out; and b) said angular cut-out comprises a first and second tapered edge.

13. The apparatus of claim 12 wherein the prong extends from the narrowing portion a distance as deep as the angular cutout.

14. A drywall installation and nail removal apparatus, said apparatus comprising:

a) a shaft portion having a first end and a second end;

b) a prong placed on the shaft portion first end at an obtuse angle to the shaft first end; and c) a slide movably attached to the shaft portion, the slide being moveable to partially cover the prong;

wherein the slide second portion has at least one extension and the shaft has slide indentions.

15. The apparatus of claim 14 wherein the slide has an angled portion and a second portion.

16. The apparatus of claim 15 wherein the angled portion of the slide movably covers the prong.

17. The apparatus of claim 14 wherein:

a) there are first and second extensions;

b) the shaft portion comprises a slide side, a first and second edge side, and a bottom side;

c) the first extension wraps around the first edge side and a portion of the bottom side; and d) the second extension wraps around the second edge side and a portion of the bottom side.

18. The apparatus of claim 17 wherein the angled portion has a width about the same as the width of the slide side of the shaft.

19. The apparatus of claim 14 wherein the slide has an angled portion and a curved portion.

20. The apparatus of claim 19 wherein a) the shaft has a bend; and b) the slide second portion has a curved portion so that the slide may be held in place when the curved portion is moved to mate with the bend.

21. The apparatus of claim 20 wherein the shaft has indentions for receiving the slide.

* * * * *